US005195284A

United States Patent [19]

Florence

[11] Patent Number: 5,195,284

[45] **Date of Patent: * Mar. 23, 1993**

[54] DRYWELL COVER AND DRYWELL

[75] Inventor: Thomas Florence, Centerville, Mass.

[73] Assignee: Owl 1990 Trust, Hyannis, Mass.

[ * ] Notice: The portion of the term of this patent subsequent to Jul. 21, 2009 has been disclaimed.

[21] Appl. No.: 898,798

[22] Filed: Jun. 15, 1992

Related U.S. Application Data

[63] Continuation of Ser. No. 661,464, Feb. 26, 1991, Pat. No. 5,131,196, which is a continuation-in-part of Ser. No. 619,115, Nov. 28, 1990, Pat. No. 5,086,594, which is a continuation-in-part of Ser. No. 407,361, Sep. 14, 1989, Pat. No. 4,982,533, and a continuation-in-part of Ser. No. 394,635, Aug. 16, 1989, Pat. No. 4,983,069.

[51] Int. Cl.[5] ..... E04B 11/00

[52] U.S. Cl. ..... 52/169.5; 52/16; 210/164; 210/165; 405/36; 405/51

[58] Field of Search ..... 52/16, 19, 20, 169.5, 52/169.6; 210/164, 165; 404/2-5, 25, 26; 405/36, 43-45, 50, 51

[56] References Cited

U.S. PATENT DOCUMENTS

| | | | |
|---|---|---|---|
| 4,982,533 | 1/1991 | Florence | 52/169.5 |
| 5,086,594 | 2/1992 | Florence | 52/169.5 |
| 5,131,196 | 7/1992 | Florence | 52/169.5 |

*Primary Examiner*—Richard E. Chilcot, Jr.
*Attorney, Agent, or Firm*—Richard P. Crowley

[57] ABSTRACT

A drywell cover to cover a drywell and a drywell system employing the drywell and cover wherein the drywell cover comprises a base cover having a raised, central wall section such as a round cylinder and an open inner section and a plurality of at least three therein supporting rib elements on the top surface of the base cover and extending from the periphery of the base cover to the raised wall section.

10 Claims, 1 Drawing Sheet

DRYWELL COVER AND DRYWELL

REFERENCE TO PRIOR APPLICATION

This is a continuation of copending application Ser. No. 07/661,464, filed Feb. 26, 1991, now U.S. Pat. No. 5,131,196, which is a continuation-in-part of 619,115, filed Nov. 28, 1990, now U.S. Pat. No. 5,086,594, which is a continuation-in-part of Ser. No. 407,361, filed Sep. 14, 1989, now U.S. Pat. No. 4,982,533, which is a continuation-in-part of Ser. No. 394,635, filed Aug. 16, 1989, now U.S. Pat. No. 4,983,069.

BACKGROUND OF THE INVENTION

The control and flow of surface water such as rain water is important in preventing the buildup of surface water adjacent foundations of other structures. Generally, drywells are employed to store large quantities of surface water therein and to discharge the surface water beneath the ground away from the foundation wall or structure and over a defined distribution area. Typically, drywells are composed of heavy, precast concrete structures, generally cylindrical in shape, but may also be square or rectangular, with one or more side wall holes of large diameter for inlet and outlet pipe. A plurality of generally smaller diameter holes, are usually uniformly distributed over a substantial part of the side walls and, precast in the cylindrical concrete wall, permit the drainage of water radially outward from the drywell. Typically, the drywell includes a heavy, solid, concrete bottom and top cover, such as a removable bottom and top cover. Generally, the top cover may have an opening therein in the top surface to serve as an opening with or without a grate for receiving surface water or the bottom cover may have an opening therein for the discharge of water.

The parent application is directed to a composite drywell and drywell system and method for employing a composite drywell, which composite drywell has a removable top and bottom section. The drywell is composed of a plurality of separate edge interlocked arcuate wall sections, which together form the peripheral wall of the drywell. Each section having a one side edge with an opening extending substantially the length of the side edge and the other side edge having a beaded side edge, or other means, for interlocking the side edges of related sections together, typically to form a cylindrical drywell wall. The sections have a plurality of large and small diameter, or other, ports for the introduction and distribution of water from the drywell. The composite drywell comprises an injection-molded plastic or polymeric drywell, which is lightweight and, with the arcuate sections, may be easily stored together in a nesting-type arrangement for easy transport. Such composite drywell may include removable top and bottom sections which may be fitted to the top and bottom of the drywell.

It is desirable to provide for a drywell cover and drywell with said cover, which drywell cover may be easily and inexpensively molded of a plastic type material, particularly as a single, injected molded piece and which cover is designed to have sufficient strength as to be employed as a top or bottom cover for a drywell, particularly a composite drywell described in the parent application. The drywell cover may be easily transported to the desired site, together with the sections of the composite drywell, and installed on site. The drywell cover has many advantages over the heavy precast concrete covers typically employed with drywell.

SUMMARY OF THE INVENTION

The invention relates to a drywell cover and a drywell and drywell system employing the drywell cover.

The invention comprises a cover typically for use with a drywell such as a cylindrical drywell, which drywell is adapted to be installed beneath the ground and to receive surface water therein and to discharge surface water therefrom. The drywell cover comprises a plastic or polymeric cover which may be injection molded of a plastic, such as a vinyl chloride resin or a polyalkalene resin such as a polyethylene or other hard, injectionable-type, moldable, plastic material, which cover is lightweight so that it may be easily transported and used and has sufficient strength, by virtue of its design and construction, so that it may be employed as a top or bottom cover of the drywell.

The cover comprises a base cover having an outer periphery and a top and bottom surface, which base cover is designed to have a surface area and shape which extends over the top or the bottom of the drywell to be covered. For the purposes of illustration, only the drywell cover will be referred to as a cylindrical drywell cover for use with a cylindrical drywell such as a drywell employed in the invention described in the parent application; however, it is recognized that the drywell cover so described and illustrated may be employed on other drywells both as a top or bottom cover or as a cover for other types of water and fluid receiving containers.

The drywell cover is designed so as to provide for supporting ribs and an open, generally central, section extending above the top surface of the base cover, which central section has a receiving section therein to receive water. Typically, the drywell cover comprises the base cover with a generally central, raised, wall section of defined height extending from the top surface of the base cover and defining a raised inner receiving section and which raised wall section may, for example, be rectangular, square, or more typically, is a cylindrical raised section. The raised wall section generally may be raised to any defined height, but often ranges from about 6 to 18 inches and generally has a diameter, for example, where it is a cylindrical raised section of from about 4 to 12 inches or more. The receiving section, when it is a cylindrical section, is designed to receive a grate therein through which surface water is introduced or is designed to receive a 4, 6, 8 inch or larger size pipe. The drywell cover may thus be employed either as the top or as the bottom of the drywell.

The drywell cover has a base cover with a plurality of at least three generally uniform, radially distributed raised rib elements extending on the top surface of the base cover between the outer periphery and the raised wall section in the central portion of the base cover. The raised rib elements are typically thin and extend generally in a triangular shape from a point or slightly raised section on the outer periphery to about the height, or slightly below, of the raised central wall section. The raised rib elements are so formed and distributed in number to provide support to the outer surface of the raised wall section and are integrally molded thereto, and to the overall design of the drywell cover. When the cover, for example, is installed as a top cover, and soil placed over the cover and up to the height of the raised wall section where the receiving section is to receive water therein, then the soil pushing down against the top cover further supports, through the raised rib elements, the outer wall of the raised wall section.

A plurality of generally raised, supporting rib sections may be used. Typically, at least three raised rib sections are used, or possibly four, for square wall sections. Where additional strength is desired, additional rib elements may be added, typically in a radial, generally uniform fashion about the round sections. The inner section defined within the wall section, called the receiving section, may be molded as an open section, left open for the introduction of water or the installation of a pipe therein or may be fitted or molded with a grate thereover. In addition, the section within the wall section may also be formed as a knock-out section, that is, molded with mechanical, weakened tabs about an inner blocking section so that, on installation, the user may merely use the cover as the drywell cover without any opening in the receiving section, or may, if desired, merely knock out by striking the mechanically weakened section, to knock out, for example, a cylindrical port for the introduction of a grate section or a pipe. The knock-out section may, for example, be formed by weakened tabs around the periphery of a circular section, such as disclosed more particularly for use in the wall section of the drywell, as in U.S. Pat. No. 4,983,069, issued Jan. 8, 1991. The rib sections may extend upwardly in a generally uniform, straight line from the outer periphery of the base cover toward the wall section and generally are molded integrally with the outer surface of the wall section and typically extend generally to about the height, or slightly below the height, of the raised wall section. The ribs provide support for the raised wall section and provide for a lightweight, rugged, easily transported and installed drywell cover.

The drywell covers of the invention may be so designed as to have a slightly raised, strengthened, section, e.g. a cylindrical rod, at the outer peripheral edges thereof, and when used with the composite drywell of the parent application, the number of ribs conform to the number of the sections of the composite drywell, so that the rod ends of the rib elements may be placed directly over the interlocking edge portions of the composite drywell, further strengthening the top cover.

The invention will be described for the purposes of illustration only in connection with certain illustrated embodiments; however, it is recognized that various changes, modifications, additions and improvements may be made by those persons skilled in the art, all falling within the spirit and scope of the invention.

DESCRIPTION OF THE EMBODIMENTS

Figure 1:
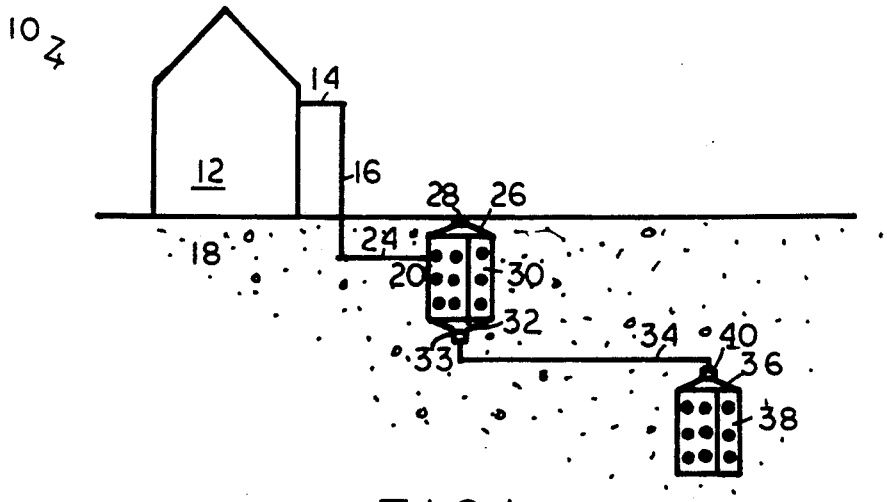
FIG. 1 is a schematic illustration of a drywell system employing a composite drywell with a drywell cover of the invention.

FIG. 1 is a schematic illustration of a drywell system 10 including a house 12 having a gutter 14 with a downspout 16 which is connected through outlet port 24 to a composite drywell 20 beneath the ground 18. The drywell 20 has a plurality of distribution drainage ports 30 and a top drywell cover 26 of the invention, including a raised cylindrical section 28 which is flush to the ground to permit the entry into the open top of the raised section 28 of surface water, while the downspout 16 connects with the port 24 and permits the introduction of water pouring on the roof of the residence 12 into the interior of the plastic, composite, arcuate formed drywell 20. The drywell also includes a drywell cover as a bottom 32 with a cylindrical outlet 33 connected to a drain pipe 34 which leads to the top of another top drywell cover 36 having an outlet 40 in a composite drywell 38 which permits the water which is not distributed through drywell 20, to be discharged through the bottom of the drywell 20 through the outlet 33 pipe 34 and into the top cylindrical port 40 in the top cover 36 and into the interior of composite drywell 38 to be further distributed. FIG. 1 illustrates the employment of the drywell cover 26 of the invention as a top drywell cover and an open top as a receiving section for surface water, as well as a bottom cover of a drywell and also as a top drywell cover on another drywell.

Figure 2:
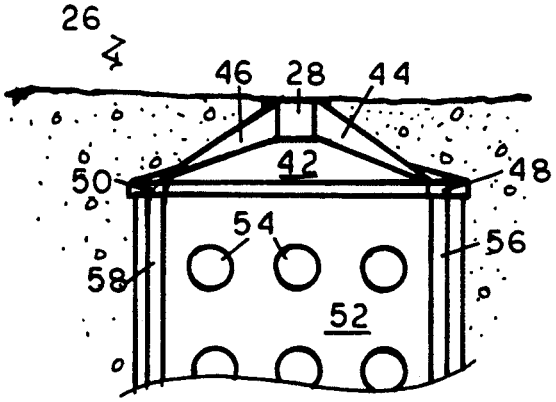
FIG. 2 is a perspective view from above of the drywell cover of FIG. 1 on a composite, plastic drywell.
Figure 3:
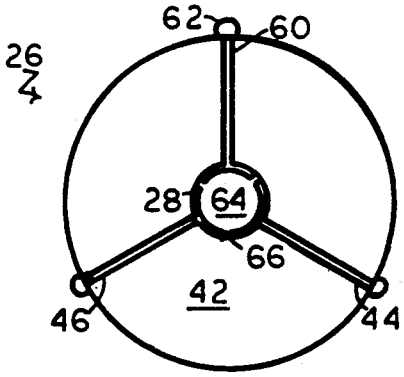
FIG. 3 is a top plan view of the drywell cover of FIG. 2.

FIG. 2 and FIG. 3 show the drywell cover 26 form of an injection molded plastic, such as polyethylene, having a circular base cover 42 of a defined diameter to cover the top of the composite drywell and typically having a sufficient thickness to support the earth 18 piled on top of the drywell cover ranging from about ¼to ½inch in thickness. The drywell cover 26 has a raised, generally cylindrical, wall section 28 which ranges from 4 inches to 12 inches and which is adapted to either receive a cylindrical grate in the top thereof, or to receive a pipe, or merely to receive surface water with the height of section 28 generally flush with the ground 18. Integrally molded on the top surface of the base cover 42 and extending between the outer periphery of the base cover 42 and the outer wall of the raised cylinder 28 are three, equally radial distributed ribs 44, 46 and 60, generally triangularly shaped and extending outwardly in a straight line from the outer periphery to the height of the raised cylindrical section 28. The raised rib sections 44, 46 and 60 served to provide additional strength to the cover when dirt is placed on top of the cover. As illustrated, the raised rib elements 44, 46 and 60 extend from slightly raised, solid rods 48, 50 and 62 on the outer periphery which rods are designed to be placed directly over the interlocking edges 56 and 58 as illustrated in FIG. 2 of the composite, arcuately composed drywell 52 having distribution ports 54. As illustrated in FIG. 2 the drywell cover is so positioned so that the solid rod elements 48, 50 and 62 are placed directly over the edge-interlocking elements 56 and 58 of the composite drywell to provide additional support for the cover. It is recognized that the drywell cover, as described and illustrated, may be employed on other prior art drywells other than the composite drywell.

FIG. 3 is a top plan view of the drywell cover 26 showing within the open section of the raised cylinder 28 a plastic knock-out section 64 secured by weakened tabs 66 to the inner, lower section of the inner wall of the raised, cylindrical section 28. In use, the plastic molded knock-out section 64 may be retained where the drywell cover is not used to have water enter the interior of the raised cylinder, or where a pipe or the opening needs to be open. The knock-out cover 64 be easily removed by a hammer blow to open the passageway. Of course, if desired, the drywell cover 26 may be injection molded without any knock-out cover 64 and with the inner section of the raised cylinder 28 open.

Figure 4:
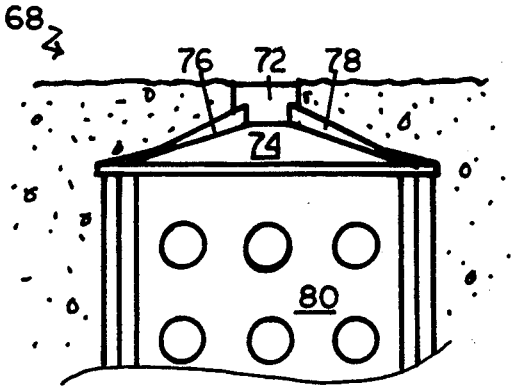
FIG. 4 is a sectional, enlarged, illustrated view of another embodiment of an installed drywell cover of the invention.

FIG. 4 is a schematic, enlarged, sectional view of another embodiment of a drywell cover 68 having a raised, cylindrical section 72 buried beneath the ground 70 and with the top of the cylinder flush with the ground to serve for receiving surface water with a circular base cover 74 and with the drywell cover 68 placed on a drywell 80 with supporting triangular supporting ribs 76 and 78 as illustrated being two, of say three, radial distributing ribs. However, in this embodiment the ribs do not extend to the top of the defined height of the cylindrical section 72, but rather only to about 50% of the raised cylindrical section so as to permit earth or gravel to be fully packed around the whole periphery of the raised section 72.

Figure 5:
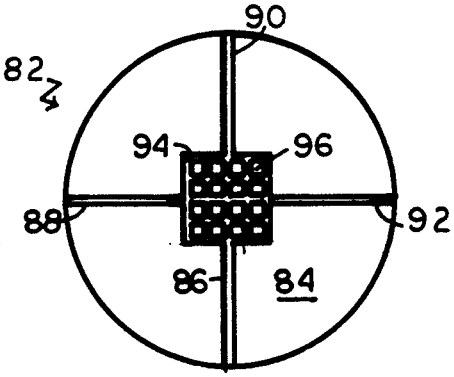
FIG. 5 is a top plan view of a further embodiment of the drywell cover of the invention.

FIG. 5 is a top plan view of further embodiment of a drywell cover 82 wherein the drywell 82 has a base cover 84 and four triangularly extending arms 88, 90, 92 and 86 extending from the outer peripheral surface of the base cover toward and into a square, raised, wall section 94 and which includes, on its open top, a grate 96 which covers the top of the raised wall section 94. The interior of the raised wall section 94 is open, so that when the drywell cover 82 is in place on top of a drywell, the grate section 86 is placed generally flush with the ground level and surface water may enter through the grate 96 into the interior of the drywell in which the top cover 82 is employed. As illustrated, there are four radially extended rib-supporting elements generally molded into the wall surface of the raised section 94 provide additional strength when dirt is piled on top of the drywell cover 82.

As illustrated, the drywell cover of the invention may be a single injection molded polymer which is lightweight, yet has radially supporting ribs and a raised central section which may be employed as a bottom or top cover in a drywell, particularly a composite drywell.

What is claimed is:

1. A cover for a drywell, which cover comprises:

a) a base cover having an outer periphery and a top and bottom surface and which base cover is adapted to extend over the drywell to be covered;

b) a generally central, raised wall section of defined height extending from the top surface of the base cover and defining an inner section;

c) a plurality of at least three, generally uniformly spaced apart, radially raised support rib elements on the top surface and extending between the outer periphery of the top surface and the raised wall section; and d) an inner section of the wall section which includes a knock-out cover with mechanically weakened supports, which knock-out cover is adapted to be easily removed to open the inner section.

2. The cover of claim 1 wherein the base cover is circular and the raised wall section is a raised cylinder.

3. The cover of claim 2 wherein the raised cylinder wall section has a diameter ranging from about 4 to 12 inches.

4. The cover of claim 2 wherein the raised wall section is generally circular and defines an open, circular, inner section.

5. The cover of claim 1 which includes rod-like elements extending generally perpendicularly from the top surface of the cover and on the outer periphery where the rib elements extend inwardly.

6. The cover of claim 5 which comprises an integrally all plastic molded cover.

7. The cover of claim 6 wherein the knock-out cover and mechanically weakened supports comprise a central knock-out section positioned within and spaced apart from the inner wall of the wall section and substantially extending across the wall section and a plurality of generally uniformly spaced apart tab sections extending between the outer periphery of the knock-out section and the inner wall of the wall section to retain the knock-out section in position.

8. The cover of claim 1 wherein the raised rib sections are generally triangular in shape and extend generally perpendicularly and uniformly upwardly from the stop surface.

9. The cover of claim 1 wherein the raised rib elements extend at the one end generally to the height of the raised wall section.

10. The cover of claim 1 wherein the raised wall section is generally rectangular, and which includes four raised rib elements extending from the outer periphery of the base cover, and each rib element generally perpendicular to each respective, raised wall section.

11. The cover of claim 1 wherein the raised wall section has a height of about 6 to 18 inches from the top surface of the base cover.

12. A composite drywell which comprises a plurality of arcuate, edge-interlocked, plastic wall sections to form a cylindrical drywell wall, the composite drywell including the drywell cover of claim 1.

13. A composite drywell which comprises:

a) at least three arcuate plastic wall sections having interlocked edges to form a cylindrical drywell wall; and b) a drywell top cover of claim 24 and wherein the rod-like elements at the peripheral outer end of the rib elements are positioned directly over the top of the respective interlocked edges of the drywell wall.

14. A drywell which comprises a drywell to receive water therein and which drywell includes the drywell cover of claim 1.

15. A drywell drainage system for the collection and distribution of surface water and which system comprises:

a) a water source;

b) a drywell positioned beneath the ground to receive water from the water source; and c) the drywell containing the drywell cover of claim 1.

16. An all plastic, integrally molded drywell cover for a cylindrical drywell, which cover comprises:

a) a base cover having a circular periphery and a top surface and which cover has a diameter sufficient to cover the top or bottom of the drywell with which the cover is to be used;

b) a raised, cylindrical wall section having a defined height of about 6 to 18 inches and a diameter of about 4 to 12 inches extending generally upwardly from the top surface of the base cover and generally centrally disposed thereof and having an inner section which is adapted to be opened;

c) at least three generally uniformly spaced apart, radially raised, supporting rib elements of generally triangular shape integral with and extending between the outer periphery of the base cover and the raised, cylindrical wall section, the rib elements angled upwardly from the outer periphery to the height of the raised, cylindrical wall section; and d) a knock-out cover with a plurality of generally uniformly spaced apart peripheral, mechanically weakened tab supports to retain the knock-out cover within the raised wall section, which knock-out cover is adapted to be easily removed to open the inner section.

17. The cover of claim 16 which includes a plurality of solid rod-like elements extending generally perpendicularly from the top surface of the base cover and at the outer periphery of each of the rib elements.

18. A drywell to receive and distribute water which drywell includes as a top or bottom cover, the plastic cover of claim 16.

19. A composite drywell which comprises a plurality of edge-interlocked wall sections to form a drywell wall and which composite drywell includes as a top cover the cover of claim 16.

20. The composite drywell of claim 16 wherein the top cover is positioned so that the solid rod-like elements are directly over each of the edge-interlocked wall sections of the drywell wall.

* * * * *

UNITED STATES PATENT AND TRADEMARK OFFICE

CERTIFICATE OF CORRECTION

PATENT NO. : 5.195,284

DATED : March 23, 1993

INVENTOR(S) : Thomas Florence

It is certified that error appears in the above-identified patent and that said Letters Patent is hereby corrected as shown below:

column 6, line 43, delete "24" and insert --5--.

Signed and Sealed this

Sixteenth Day of November, 1993

*Attest:*

*Attesting Officer*

Bruce Lehman

BRUCE LEHMAN

*Commissioner of Patents and Trademarks*